US007343762B1

(12) United States Patent
East et al.

(10) Patent No.: US 7,343,762 B1
(45) Date of Patent: Mar. 18, 2008

(54) GARAGE DOOR LOCKING SYSTEM

(75) Inventors: A. Anthony East, East Bend, NC (US); Tracy Edmonds, Bridgnorth (GB); Tony Jarrett, Telford (GB); Martin Murdoch, Telford (GB)

(73) Assignee: Amarr Company, Winston-Salem, NC (US)

( * ) Notice: Subject to any disclaimer, the term of this patent is extended or adjusted under 35 U.S.C. 154(b) by 0 days.

(21) Appl. No.: 10/687,528

(22) Filed: Oct. 16, 2003

(51) Int. Cl.
*E05B 13/10* (2006.01)

(52) U.S. Cl. ..... 70/224; 70/217; 70/481; 70/485; 70/DIG. 11; 292/36; 292/38; 292/48; 292/50; 292/DIG. 36

(58) Field of Classification Search ..... 70/DIG. 11, 70/478–480, 103, 116, 120, 467, 473–475, 70/468, 477, 481–485, 215–217, 224; 292/DIG. 36, 292/36, 38, 48, 50, 34, DIG. 37, 46, 359, 292/356, 357, 169.14, 169.15, 169.16, 169.17; 160/207, 201, 213
See application file for complete search history.

(56) References Cited

U.S. PATENT DOCUMENTS

| | | | | | |
|---|---|---|---|---|---|
| 1,495,820 | A | * | 5/1924 | Tierney | 70/108 |
| 1,858,804 | A | * | 5/1932 | Carlson | 292/36 |
| 1,912,829 | A | | 6/1933 | Crume | |
| 2,048,377 | A | * | 7/1936 | Robinson | 70/100 |
| 2,216,335 | A | * | 10/1940 | Ashton | 292/40 |
| 2,309,437 | A | | 1/1943 | Blodgett | 292/1 |
| 2,427,909 | A | * | 9/1947 | Howell | 70/216 |
| 2,473,065 | A | * | 6/1949 | Miller | 292/37 |
| 2,580,584 | A | * | 1/1952 | Nowak | 292/36 |
| 2,584,088 | A | * | 1/1952 | Floyd | 292/34 |
| 2,628,117 | A | * | 2/1953 | Robinson | 292/336.3 |
| 3,292,399 | A | * | 12/1966 | Dyer | 70/100 |
| 3,683,652 | A | * | 8/1972 | Halopoff et al. | 70/467 |
| 3,996,591 | A | * | 12/1976 | Hayward | 292/3 |
| 4,015,454 | A | * | 4/1977 | Struble | 70/2 |
| 4,109,494 | A | * | 8/1978 | Allemann | 70/107 |
| 4,288,944 | A | * | 9/1981 | Donovan | 49/395 |
| 4,480,863 | A | | 11/1984 | Hormann | 292/216 |
| 4,966,018 | A | * | 10/1990 | Hauber | 70/208 |
| 5,072,978 | A | * | 12/1991 | Woodward | 292/359 |
| 5,150,934 | A | * | 9/1992 | Grody | 292/288 |
| 5,180,201 | A | * | 1/1993 | Hauber | 292/336.3 |
| 5,284,372 | A | * | 2/1994 | Lin | 292/336.3 |
| 5,350,213 | A | * | 9/1994 | Bernardo | 296/98 |
| 5,595,076 | A | | 1/1997 | Weinerman et al. | 70/208 |
| 5,713,612 | A | * | 2/1998 | Kajuch | 292/36 |
| 6,352,289 | B1 | | 3/2002 | Fan | 292/226 |

* cited by examiner

*Primary Examiner*—Lloyd A. Gall
(74) *Attorney, Agent, or Firm*—Womble Carlyle Sandridge & Rice, PLLC

(57) ABSTRACT

A garage door locking system includes a central elongated spindle having an inside end and an outside end. An outside locking member is positioned on the outside end of the spindle, and an inside locking member is positioned on the inside end of the spindle. An actuator yoke on the inside end of the spindle includes at least one end configured for connection to an end of an elongated lock bar or a snap latch cable.

16 Claims, 10 Drawing Sheets

GARAGE DOOR LOCKING SYSTEM

TECHNICAL FIELD

The invention generally relates to latch and lock mechanisms for movable doors, and more particularly relates to latch and lock mechanisms for doors such as slidable overhead garage doors.

BACKGROUND

Garage doors generally include one of two types of locking systems. As shown in FIGS. 1-4, a first locking system includes one or two slidable lock bars 8 mounted on an interior face of a garage door 2. The door 2 shown in FIG. 1 is a sectional overhead garage door including a plurality of hinged 4 sections 3. The door 2 is slidably mounted in tracks 5 affixed to a building frame 12. One end of each lock bar 8 is connected to a rotatable lock bar disc 9 centrally mounted on an inside face of the door 2. A lock bar guide 13 also supports each lock bar 8 on the door 2. As shown in FIGS. 2 and 3, the lock bar disc 9 is rotated between a locked position in FIG. 2, and an unlocked position in FIG. 3. In the locked position (FIG. 2), the end 8*a* of each lock bar 8 is received in a slot 7 in its respective door track 5. In the unlocked position (FIG. 3), the ends 8*a* of the lock bars are retracted from their respective slots 7 in the tracks 5.

A locking mechanism 11 mounted above the lock bar disc 9 selectively permits and prevents rotation of the disc 9. Selective rotation of an actuator lever 11*a* on the lock 11 causes a bolt 11*b* to be selectively raised and lowered. As shown in FIG. 2, when the bolt 11*b* is received in a mating slot 9*a* in the disc 9, the disc 9 is prevented from rotating, and disc 9 holds the lock bars 8 in engagement with the door track slots 7, thereby preventing the door 2 from being raised in the tracks 5. As shown in FIG. 3, when the bolt 11*b* is selectively raised, the lock bar disc 9 can be sufficiently rotated to cause the lock bars to retract from the slots 7, thereby permitting the door 2 to be raised. Though the locking system shown in FIGS. 1-4 include two lock bars 8, such systems also may include a single lock bar.

As shown in FIG. 4, the lock 11 includes an exterior keyed opening 13 for permitting the lock 11 to be locked or unlocked with a key 15. An inside handle 10 and an outside handle 17 permit the disc 9 to be selectively rotated from either side of the door 2 when the lock bolt 11*b* is disengaged from the disc slot 9*a*. Lock bar locking systems require two door penetrations: a first penetration for the spindle that actuates the disc 9, and a second penetration for the lock 11. Typically, the second opening for the lock 11 is over an inch in diameter and requires the use of a hole saw. Accordingly, such systems are difficult to install, and require careful alignment between the lock bar discs 9 and their mating locks 11. In addition, such systems have an unfinished inside appearance.

A second type of known garage door locking system is shown in FIGS. 5-8. As shown in FIG. 5, so-called "snap latch" systems generally include an actuator 29 with a handle 40 rotatably mounted on an interior face of a garage door 2. At least one cable 28 is connected at one end to the disc 29, and is connected at its other end to a snap latch assembly 30. As shown in FIG. 6, the snap latch assembly 30 includes a base bracket 32 and a latch 34 that is pivotably mounted to the bracket 32 on a pin 33. The latch 34 is biased toward a locked position (as shown in FIG. 6) by a spring 35. In this locked position, the latch 38 engages a strike plate 38 affixed to a fixed member 12 such as a door track or building frame member, thereby preventing relative movement between the door 2 and fixed member 12.

To open the door 2, the actuator 29 is rotated using either the interior handle 40 or exterior handle 39 (FIG. 8) to place tension on the cables 28 as shown in FIG. 7. As the actuator 29 is rotated, the cable 28 pulls the latch 34 from engagement with the striker plate 38, thereby freeing the door 2 to move relative to the frame 12. Such systems typically include a keyed cylinder lock (not shown) in their exterior handles 39 to permit the systems to be locked or unlocked from outside a garage door 2. Unfortunately, such snap latch systems cannot be locked or unlocked from the inside of a garage door 2 and have an unfinished appearance. As indicated in FIG. 8, one advantage of snap latch locking systems is that they require a single door penetration, thereby simplifying installation.

Accordingly, there is a need for an improved locking system that overcomes the shortcomings of known garage door locking systems. Specifically, there is a need for a single locking system that can be used with either lock bars or snap latch cables. Desirably, such a locking system should require only small-diameter door penetrations, and should be lockable from both the inside and outside of a door. In addition, such a locking system should provide an attractive, finished appearance on both sides of a door.

SUMMARY

A garage door locking system includes a central elongated spindle having an inside end and an outside end. An outside locking member is positioned on the outside end of the spindle, and an inside locking member is positioned on the inside end of the spindle. An actuator yoke on the inside end of the spindle includes at least one end configured for connection to an end of an elongated lock bar or a snap latch cable.

The invention also includes a locking system for a garage door having an inside face, an outside face, and first and second opposed side edges. The locking system includes a spindle configured to be rotatably mounted in an aperture in the garage door. The spindle has an inside end and an outside end, wherein the inside end of the spindle inwardly extends a substantial distance from the inside face of the garage door. An offset actuator yoke includes a central hub portion on the inside end of the spindle and opposed ends. The central hub of the yoke is proximate to the inside end of the spindle, and the opposed ends of the yoke are substantially proximate to the inside face of the garage door when the spindle is rotatably mounted in the garage door aperture and the central hub is mounted on the spindle.

The invention further includes a garage door lock including inside and outside coaxial locks on a central spindle. An offset yoke on the spindle is configured for selective connection to at least one slidable lock bar or at least one snap latch cable.

The invention will be better understood from a reading of the following detailed description together with the drawings.

DETAILED DESCRIPTION

Figure 1:
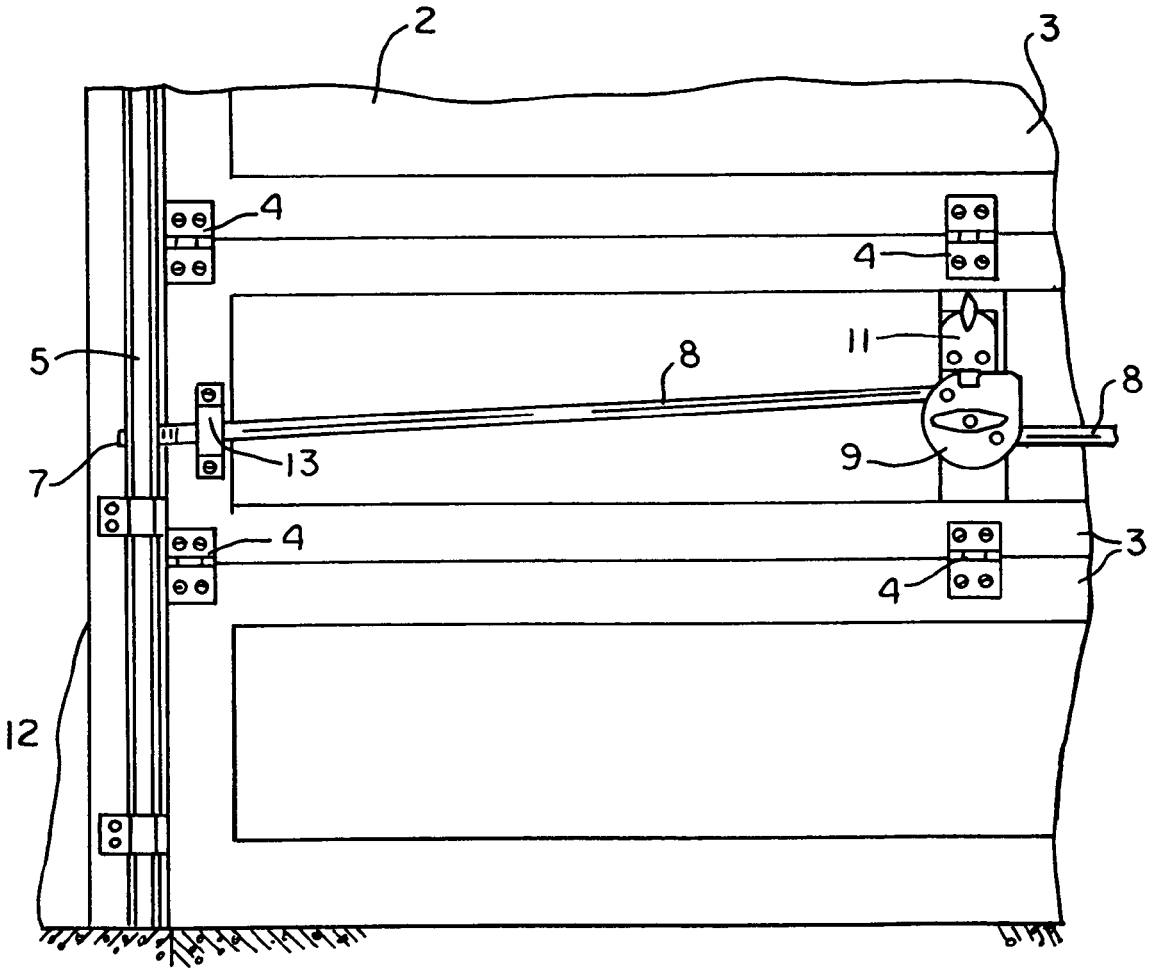
FIG. 1 PRIOR ART
FIG. 1 is an inside elevation view of a known garage door locking system.
Figure 2:
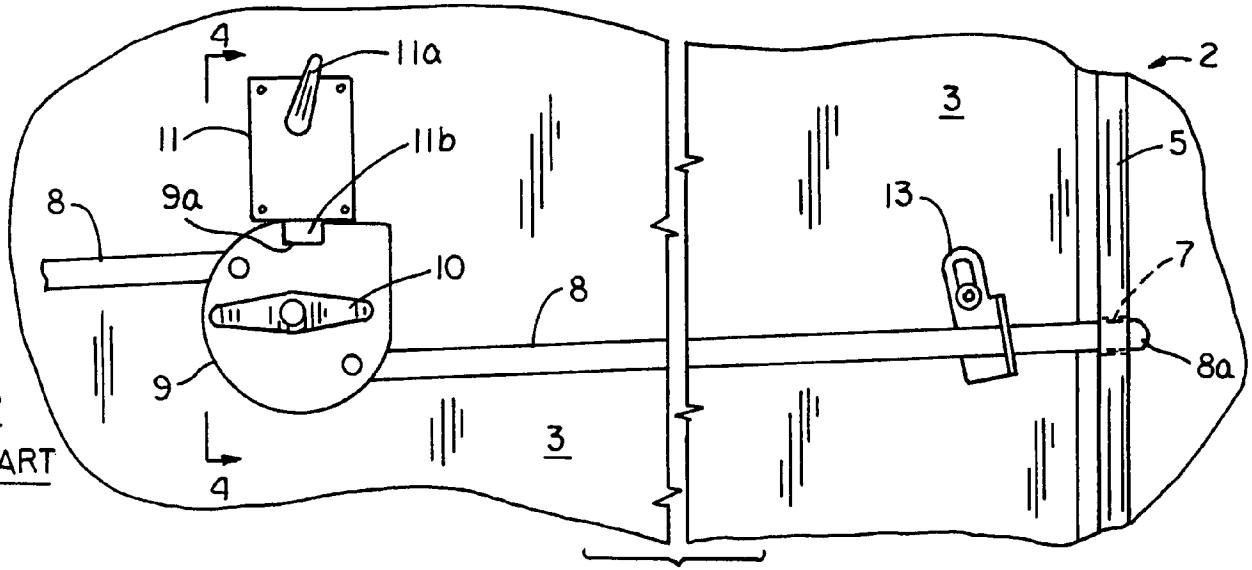
FIG. 2 PRIOR ART
FIG. 2 is a close up elevation view of the known locking system of FIG. 1 in a locked position.
Figure 3:
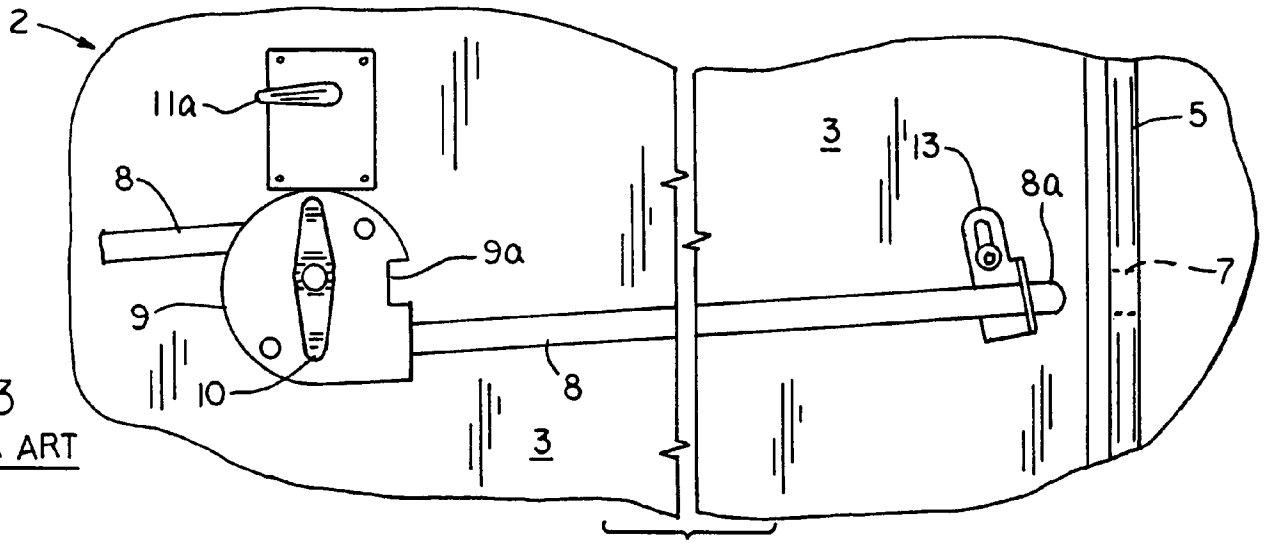
FIG. 3 PRIOR ART
FIG. 3 is a close up elevation view of the known locking system of FIG. 1 in an unlocked position.
Figure 4:
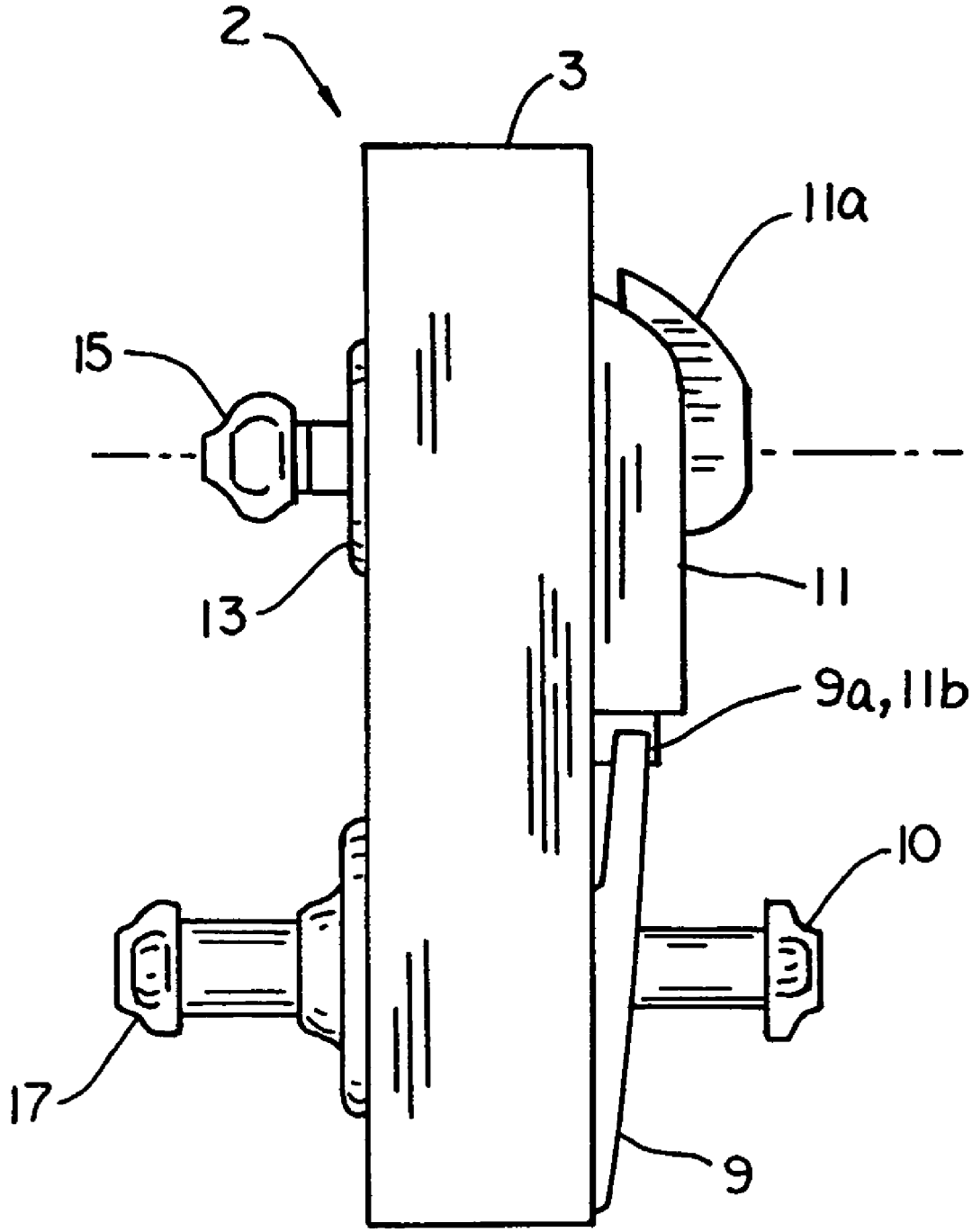
FIG. 4 PRIOR ART
FIG. 4 is a cross-sectional view taken along line 4-4 in FIG. 2.
Figure 5:
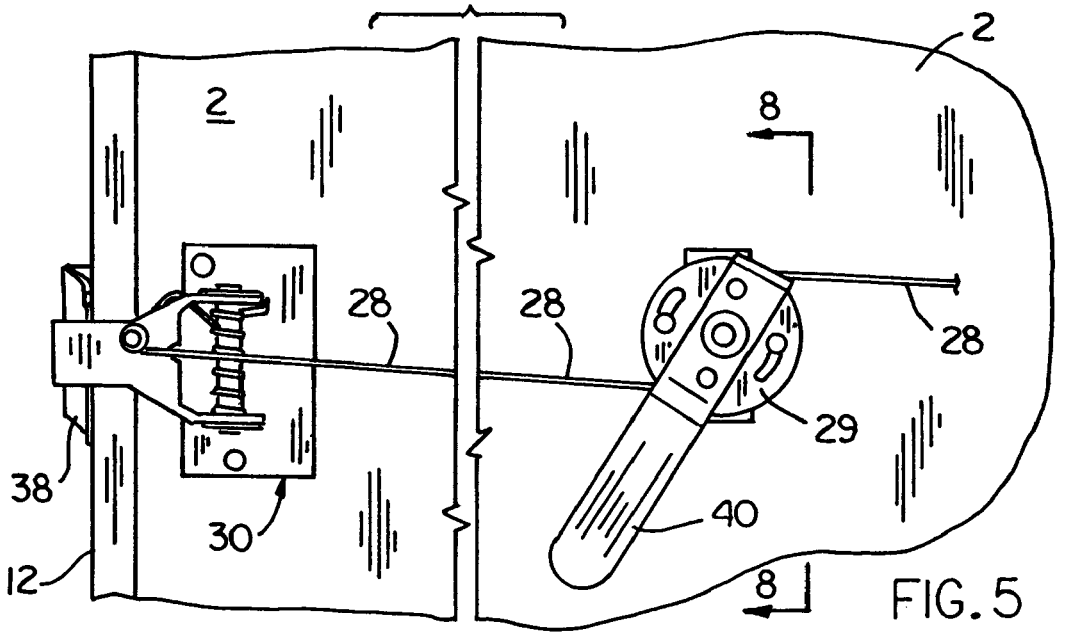
FIG. 5 PRIOR ART
FIG. 5 is an elevation view of a known snap latch locking system.
Figure 6:
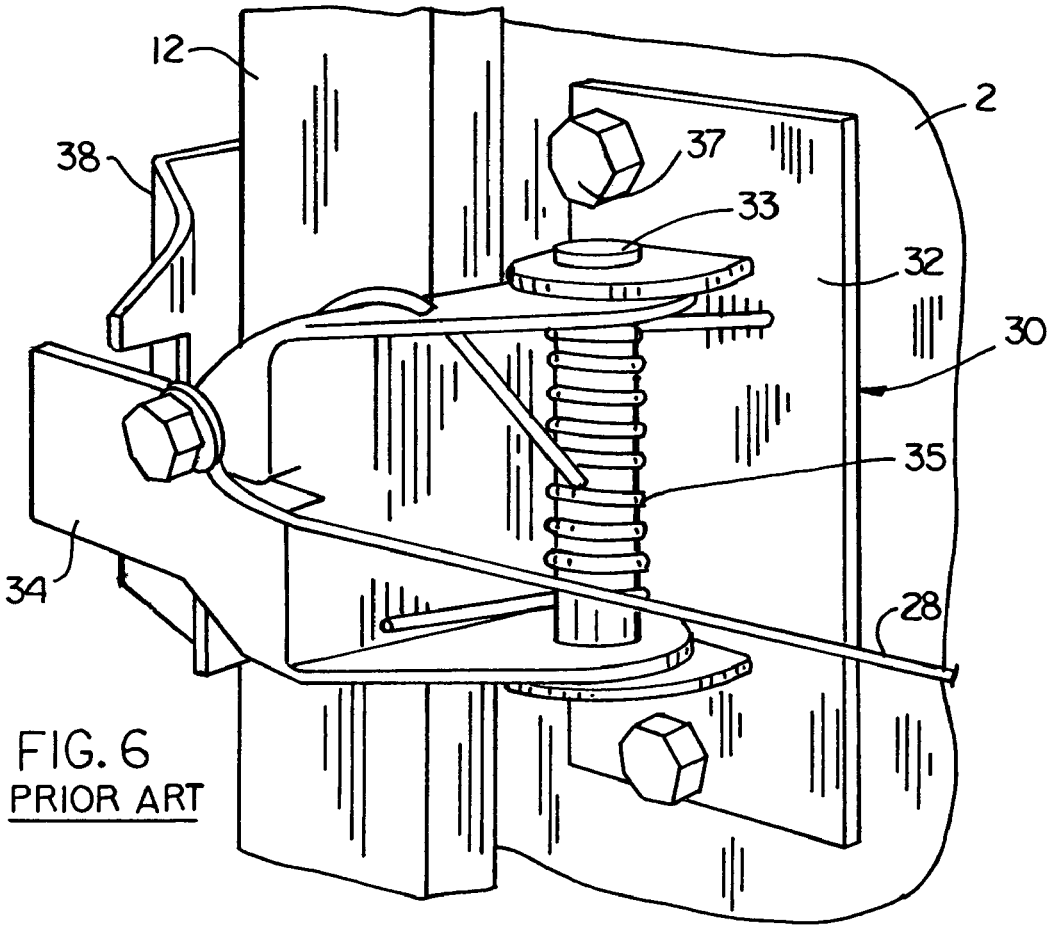
FIG. 6 PRIOR ART
FIG. 6 is a perspective view of the snap latch assembly shown in FIG. 5 in a closed position.
Figure 7:
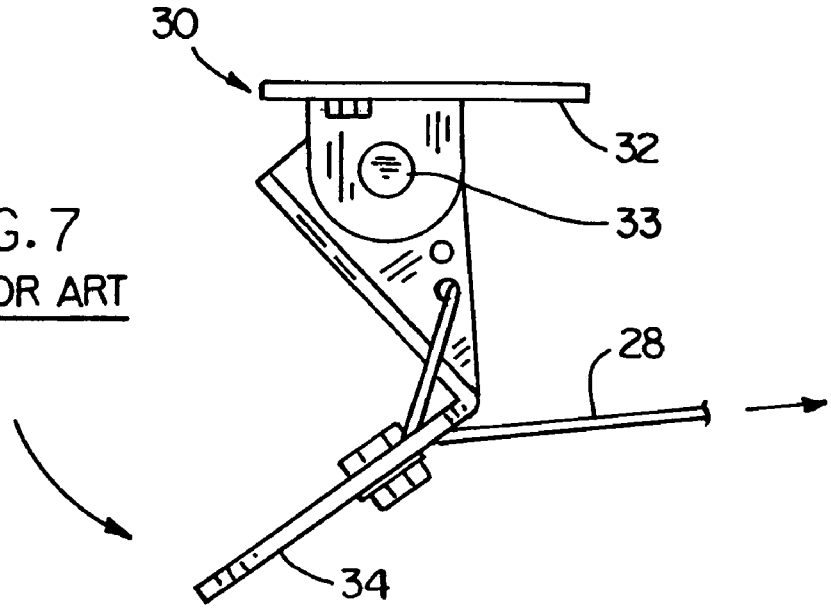
FIG. 7 PRIOR ART
FIG. 7 is a plan view of the top of the snap latch assembly of FIGS. 5 and 6 in an unlocked position.
Figure 8:
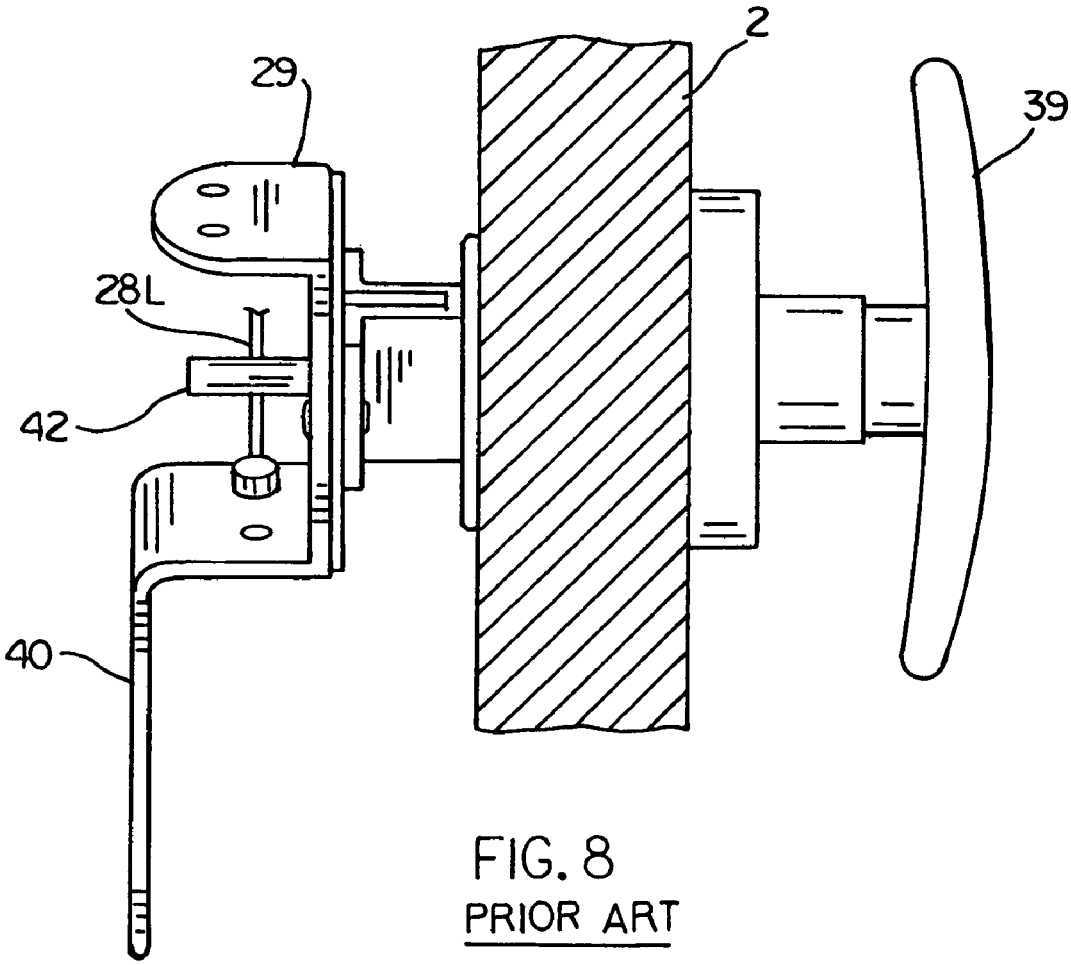
FIG. 8 PRIOR ART
FIG. 8 is a cross sectional view taken along line 8-8 in FIG. 5.

FIGS. 9-13 show various aspects of an embodiment 100 of a locking system according to the invention. The locking system 100 is capable of locking and actuating both lock bars 8 like those shown in FIGS. 1-3 and snap latch cables 28 like those shown in FIG. 5.

Figure 9:
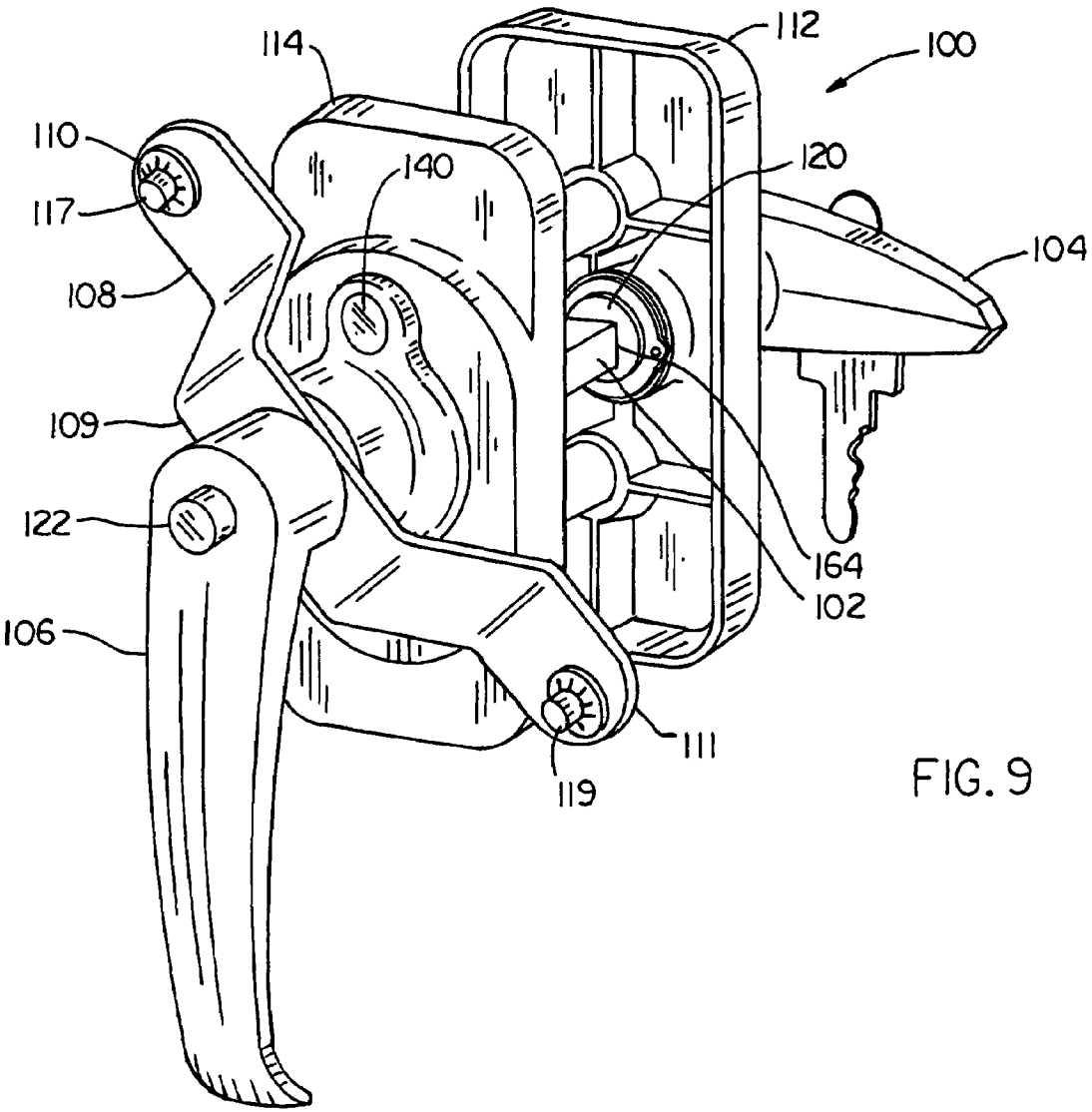
FIG. 9 is an inside perspective view of an embodiment of a garage door locking system according to the invention.
Figure 10:
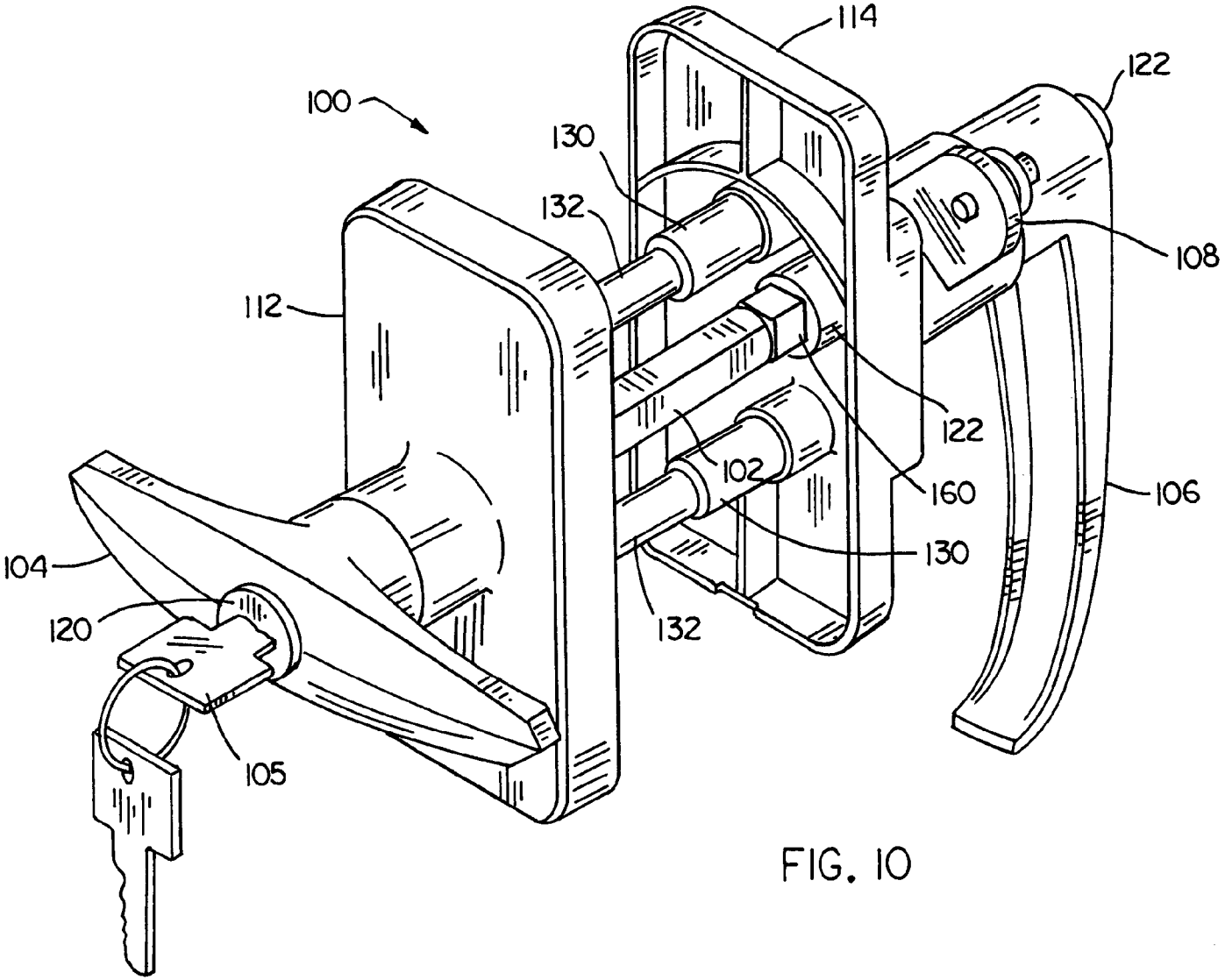
FIG. 10 is an outside perspective view of the garage door locking system shown in FIG. 9.
Figure 11:
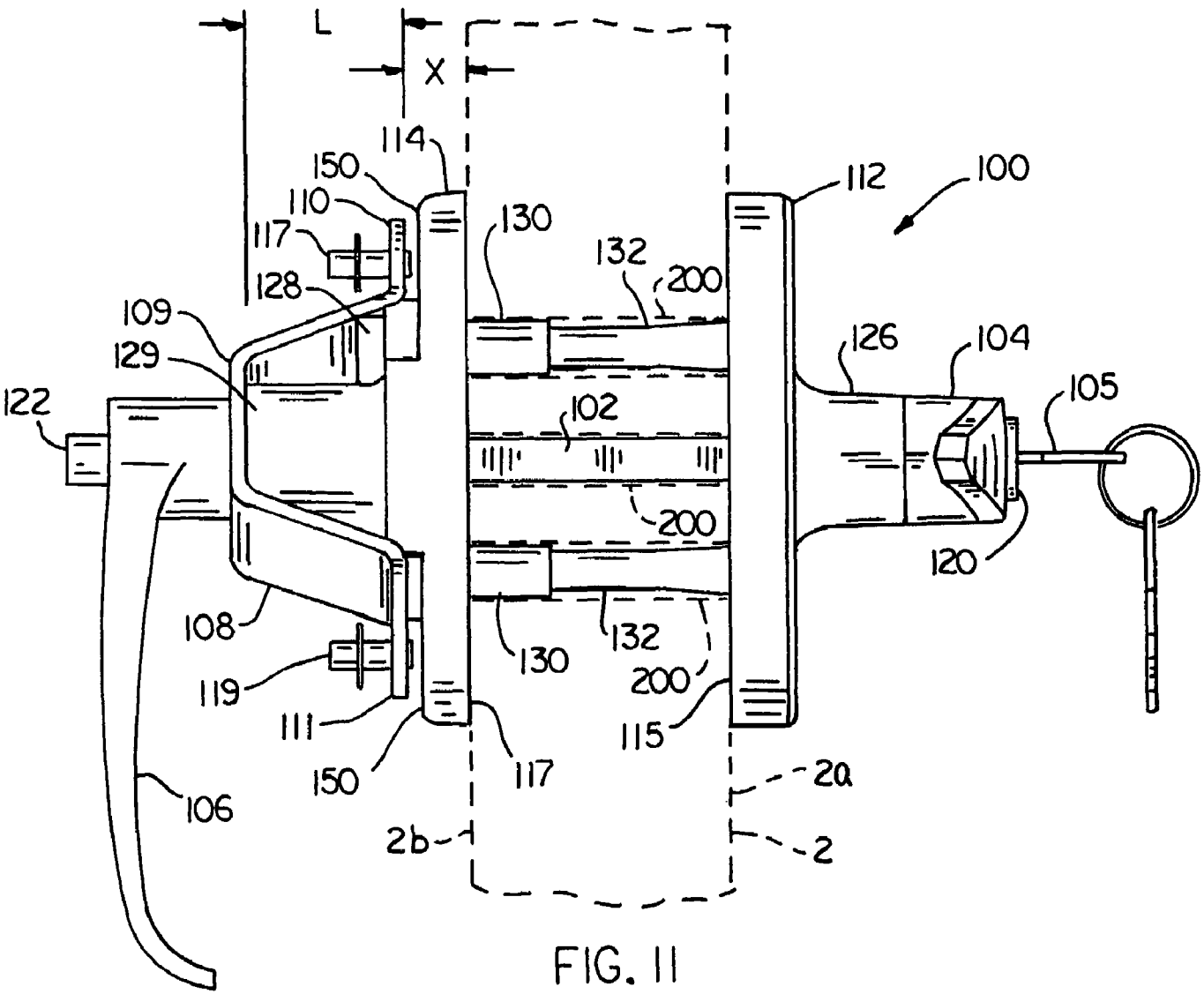
FIG. 11 is a side elevation view of the locking system shown in FIGS. 9 and 10.
Figure 12:
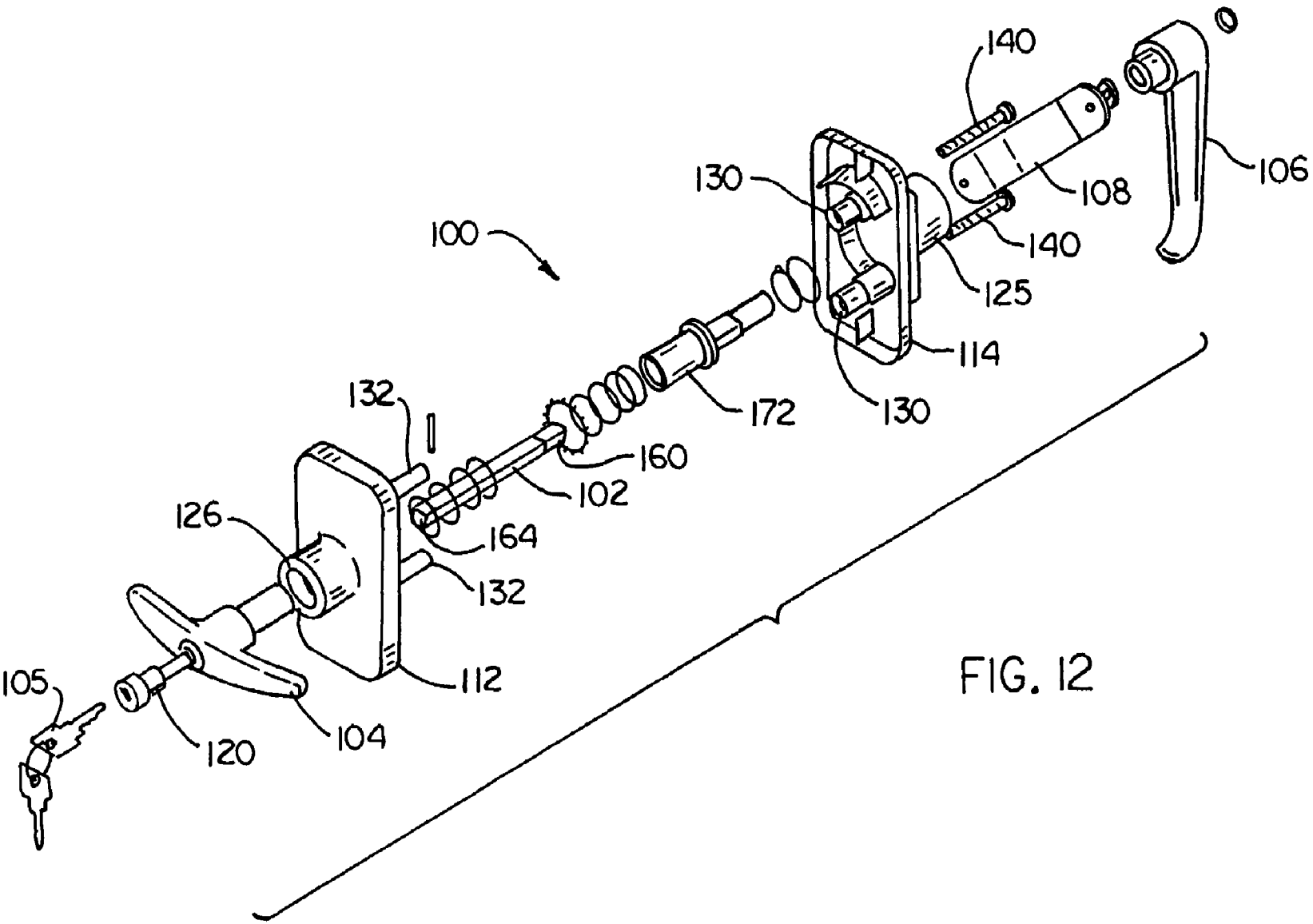
FIG. 12 is an exploded perspective view of the locking system shown in FIGS. 9-11.

As shown in FIGS. 9-11, the locking system 100 includes a central spindle 102 extending between an inside handle 106 and an outside handle 104. Preferably, the spindle 102 has a square or other non-round cross-section. An outside escutcheon 112 has an inner face 115 that mounts flush with an outer face 2*a* of a door 2 as shown in FIG. 11. The outside escutcheon 112 also includes alignment/connecting members 132 inwardly extending from the outside escutcheon 112. As shown in FIGS. 9 and 12, the outside handle 104 includes a conventional keyed lock cylinder 120 that extends through the outside escutcheon 112 and receives an outside end 164 of the spindle 102.

An inside escutcheon 114 has an outer face 117 that mounts flush with an inner face 2*b* of a door 2 as shown in FIG. 11. The inside escutcheon 114 also includes alignment/connecting members 130 outwardly extending from the inside escutcheon 114. As shown in FIG. 11, the alignment/connecting members 130 are sized and arranged to engage with the alignment/connecting members 132 on the outside escutcheon 112. As shown in FIGS. 10 and 12, the inside handle 106 includes a conventional push-button lock cylinder 122 that extends through the inside escutcheon 114 and receives an inside end 160 of the spindle 102.

As shown in FIGS. 9, 11, and 12, an actuator yoke 108 is positioned on the inside handle 106 adjacent to the inside escutcheon 114. The yoke 108 includes a central hub portion 109 and two opposed radially extending ends 110, 111. The ends are configured to receive fasteners 117, 119. The ends 110, 111 are axially offset from the hub portion 109 by an axial distance "L" as shown in FIG. 11. The offset ends 110, 111 of the yoke 109 permit the ends 110, 111 to be closely proximate to an inside face 2*b* of a door 2. In a preferred embodiment, the ends 110, 111 are within a distance "x" from the inside face 2*b* of a door 2 that is equal to about 0.5-1 inch. The proximity of the ends 110, 111 of the yoke to the inside face 2*b* of a door 2 is important to permit ends of lock bars 8 or snap latch cables 28 to be connected to the ends 110, 111 such that bars 8 or cables 28 are substantially parallel to the inside face 2*b* of the door 2. Lock bars 8 and snap latch cables 28 preferably are substantially parallel to the door face 2*b* to avoid the application of eccentric, out-of-plane loads on the lock bars, lock bar guides, snap latch cables, and/or snap latches.

FIG. 11 shows a profile for the inside escutcheon 114 that accommodates the offset shape of the actuator yoke 108. The inside escutcheon 114 includes an inwardly protruding or raised boss portion 128 and a recessed portion or portions 150. The raised portion 128 acts as a housing or axial spacer that provides room within the inside escutcheon 114 for a substantial portion of the inside lock cylinder 122. The recessed portion or portions 150 of the inside escutcheon 114 permit the opposed ends 110, 111 of the yoke 109 to rotate relative to the escutcheon 114 without interference.

As shown in FIG. 11, the alignment/connection members 130 of the inside escutcheon 114 are inserted through inside ends of corresponding penetrations or bores 200 in a door 2. Similarly, the alignment/connection members 132 of the outside escutcheon 112 are inserted through outside ends of the penetrations or bores 200, and engage the alignment/connection members 130 of the inner escutcheon within the bores. In a preferred embodiment, the penetrations or bores 200 in a door are not more than about 7/16 inch in diameter. Accordingly, the system 100 can be installed in a door 2 using a single small-diameter drill bit.

As shown in FIG. 12, threaded fasteners 140 extend through the alignment/connection members 130 of the inside escutcheon 114 and are threadably engaged with threaded bores (not shown) in mating alignment/connecting members 132. The escutcheons 112, 114 are thus securely mounted and aligned on the door 2. As can be seen by comparing FIG. 9 with FIGS. 2 and 5, the present locking system 100 provides a more finished and elegant appearance to the interior of a door than known lock bar and snap latch actuators. Preferably, the escutcheons 112, 114 are constructed of a suitable metal, though other sufficiently durable and strong materials may also be used. In a preferred embodiment, outside surfaces of the outside escutcheon 112 are coated with a corrosion-resistant coating such as a polyester powder coating to inhibit corrosion of the escutcheon 112.

Figure 13:
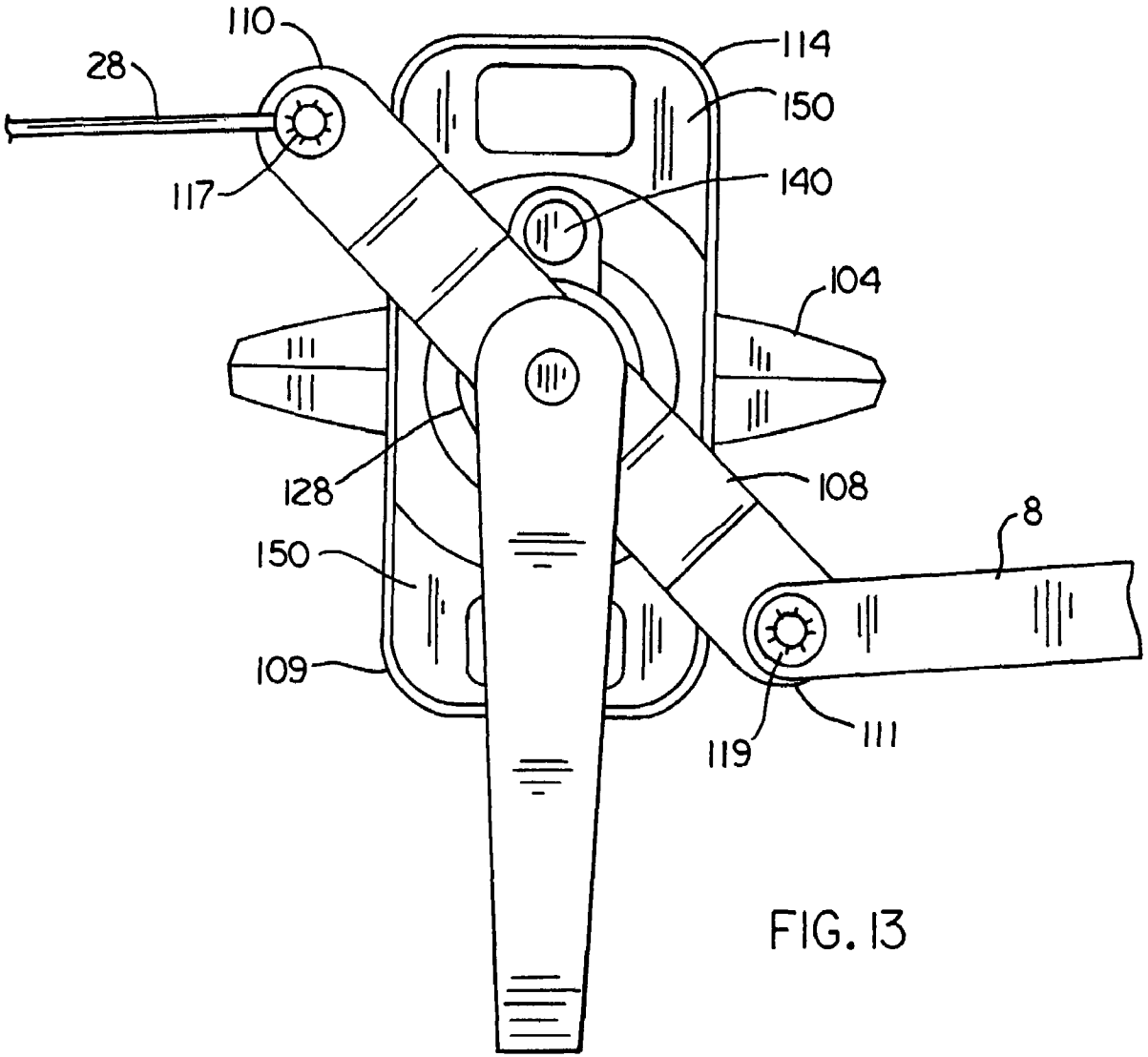
FIG. 13 is an inside elevation view of the improved locking system shown in FIGS. 9-13.

As shown in FIG. 13, the ends 110, 111 of the yoke 108 are configured for attachment to either a conventional lock bar 8 or a conventional snap latch cable 28. In a preferred arrangement, the ends 110, 111 of the yoke 108 are configured to receive fasteners 117, 119 for attachment of a lock bar 8 or cable 28 as shown. The fasteners 117, 119 may be pins, bolts, or any other fasteners suitable for securely attaching a lock bar 8 or cable 28 to the yoke 108. The system 100 may be used with one lock bar 8, two lock bars 8, one snap latch cable 28, or two snap latch cables 28.

In operation, the locking system 100 permits a door such as a garage door to be selectively locked, unlocked, latched, and unlatched. To operate the system from the outside of a door, a key 105 is inserted into the outside lock cylinder 120 to either lock or unlock the outside handle 104. When locked, the handle 104 and connected spindle 102 are prevented from rotating, and cannot be used to rotate the yoke 108 to disengage connected lock bars or snap latches that prevent the door from opening. When unlocked, the outside handle 104 and spindle 102 are free to rotate, and attached lock bars or snap latches can be selectively engaged or disengaged by rotating the handle 104 to latch or unlatch the door.

The inside lock 122 is locked by rotating the inside handle 106 until the yoke 108 is in a locked position, causing the button 122 to pop up. When the button 122 is in the up or locked position, the outside handle 106 and spindle 102 are prevented from rotating, and cannot be used to rotate the yoke 108 to disengage connected lock bars or snap latches that prevent the door from opening. Accordingly, the door can be locked from either inside or outside the door. If the inside handle 106 is locked, depressing the button 122 causes the inside lock 122 to disengage the spindle 102, and permits the door to be opened from either the inside or the outside.

As shown in FIGS. 9-13, a preferred outside handle 104 is a T-handle. Also as shown in FIGS. 9-13, a preferred inside handle 106 is an L-shaped handle. In a preferred construction, the handles 104, 106 are metal, though other suitable strong materials may also be used. Other inside and outside handles can also be used. The inside handle may be die cast, and may have an ergonomic shape. In order to inhibit corrosion, the outside handle 104 may be coated with a corrosion-resistant coating such as a polyester powder coating.

The invention has been described herein in terms of preferred embodiments and methodologies. It will be understood by those of ordinary skill in the art, however, that a wide variety of additions, deletions, and modifications might be made to the illustrated embodiments without departing from the spirit and scope of the invention as set forth in the claims.

What is claimed is:

1. A garage door locking system comprising:

(a) a central elongated spindle having an inside end and an outside end;

(b) an outside locking member on the outside end of the spindle;

(c) an inside locking member on the inside end of the spindle; and (d) an actuator yoke on the inside end of the spindle, the yoke having a first end configured for connection to a first elongated lock bar, and a second end configured for connection to a second elongated lock bar, the first and second ends outwardly extending from the locking system;

wherein both the inside locking member and the outside locking member are operable to selectively permit and selectively prevent rotation of the spindle by manipulation of the outside end of the spindle.

2. A garage door locking system according to claim 1 wherein the first end of the yoke also is configured for connection to an end of a snap latch cable.

3. A garage door locking system according to claim 1 wherein the outside locking member is a keyed cylinder lock.

4. A garage door locking system according to claim 1 wherein the inside locking member is a push-button cylinder lock.

5. A garage door locking system according to claim 1 and further comprising an outside handle on the outside end of the spindle.

6. A garage door locking system according to claim 1 and further comprising an inside handle on the inside end of the spindle.

7. A garage door locking system according to claim 1 wherein the actuator yoke includes a hub portion for connection to the inside end of the spindle, wherein the first and second ends of the yoke are offset from the hub portion such that the first and second ends are nearer the outside end of the spindle than the hub portion.

8. A garage door locking system according to claim 7 and further comprising an inside escutcheon, wherein the inside escutcheon includes a central protruding portion and a recessed portion, wherein the recessed portion provides sufficient clearance to permit selective rotation of the first and second ends of the yoke when the spindle rotates relative to the inside escutcheon.

9. A garage door locking system according to claim 1 and further comprising an outside escutcheon.

10. A garage door locking system according to claim 1 and further comprising an inside escutcheon.

11. A locking system for a garage door having an inside face, an outside face, and first and second opposed side edges, the locking system comprising:

(a) a spindle configured to be rotatably mounted in an aperture in the garage door, the spindle having an inside end and an outside end, wherein the inside end of the spindle inwardly extends a substantial distance from the inside face of the garage door;

(b) an offset actuator yoke having a central hub portion on the inside end of the spindle, and having opposed ends, wherein the central hub is proximate to the inside end of the spindle and the opposed ends outwardly extend from the locking system and are substantially proximate to the inside face of the garage door when the spindle is rotatably mounted in the garage door aperture and the central hub is mounted on the spindle;

(c) an outside locking cylinder on the outside end of the spindle; and (d) an inside locking cylinder on the inside end of the spindle;

wherein both the inside locking cylinder and the outside locking cylinder are operable to selectively permit and selectively prevent rotation of the spindle by manipulation of the outside end of the spindle.

12. A locking system according to claim 11 and further comprising an inside escutcheon configured for attachment on the inside face of the garage door, wherein the inside escutcheon includes a raised central portion and a recessed outer portion such that the recessed outer portion provides sufficient clearance to permit rotation of the opposed ends of the yoke relative to the inside escutcheon.

13. A locking system according to claim 12 and further comprising an outside escutcheon configured for attachment on the outside face of the garage door.

14. A locking system according to claim 11 and further comprising an outside handle on the outside end of the spindle and an inside handle on the inside end of the spindle.

15. A locking system according to claim 11 wherein the outside locking cylinder is a keyed locking cylinder.

16. A locking system according to claim 11 wherein the inside locking cylinder is a push-button locking cylinder.

* * * * *